US005490677A

United States Patent [19]

Black

[11] Patent Number: 5,490,677

[45] Date of Patent: Feb. 13, 1996

[54] AMUSEMENT APPARATUS

[75] Inventor: Alan J. Black, Ledstone, England

[73] Assignee: Sound Leisure Limited, Leeds, United Kingdom

[21] Appl. No.: 340,621

[22] Filed: Nov. 16, 1994

[30] Foreign Application Priority Data

May 25, 1994 [GB] United Kingdom ..... 9410161

[51] Int. Cl.[6] ..... A63F 9/02

[52] U.S. Cl. ..... 273/351

[58] Field of Search ..... 273/351, 366, 273/367, 368, 363, 383, 384

[56] References Cited

U.S. PATENT DOCUMENTS 1,559,140 10/1925 Wolkenhauer ..... 273/351
1,639,596 8/1927 Dritz ..... 273/366
2,286,151 6/1942 Miller, Jr. ..... 273/351
3,083,019 3/1963 Giuliano ..... 273/351
4,120,497 10/1978 Goldfarb et al. ..... 273/351

*Primary Examiner*—William H. Grieb
*Attorney, Agent, or Firm*—Reising, Ethington, Barnard & Perry

[57] ABSTRACT

Amusement apparatus is disclosed, comprising a number of targets (2) located beneath at least one striker (16) and means (4) for providing relative movement between the two, the or each striker being operatively connected to a user activated mechanism (20) whereby the or each striker may be caused by the user to approach the targets, the targets being operatively connected to a reward mechanism whereby should a striker hit a particular target the reward mechanism is triggered.

11 Claims, 4 Drawing Sheets

Figure 1:
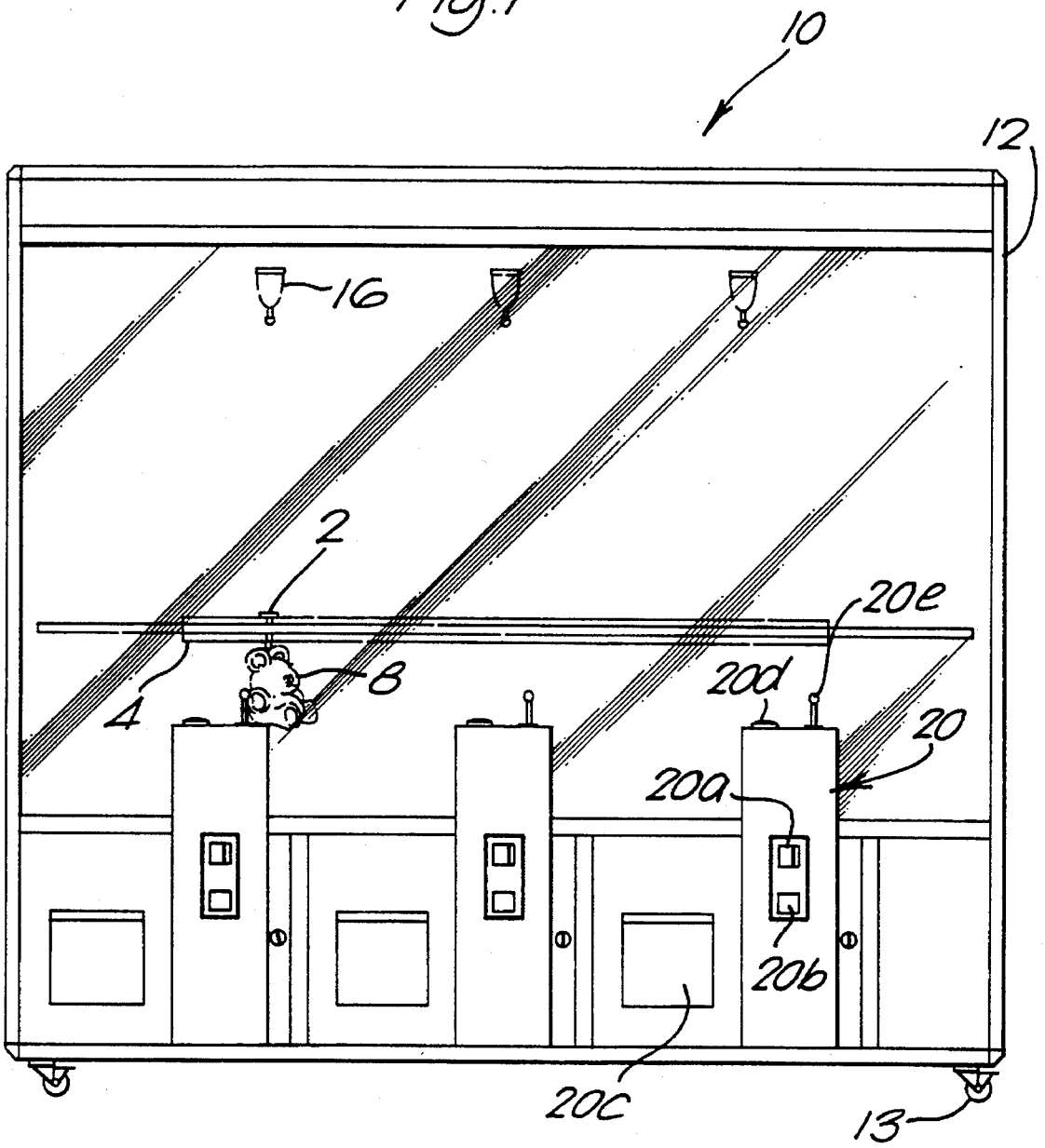

Fig. 3
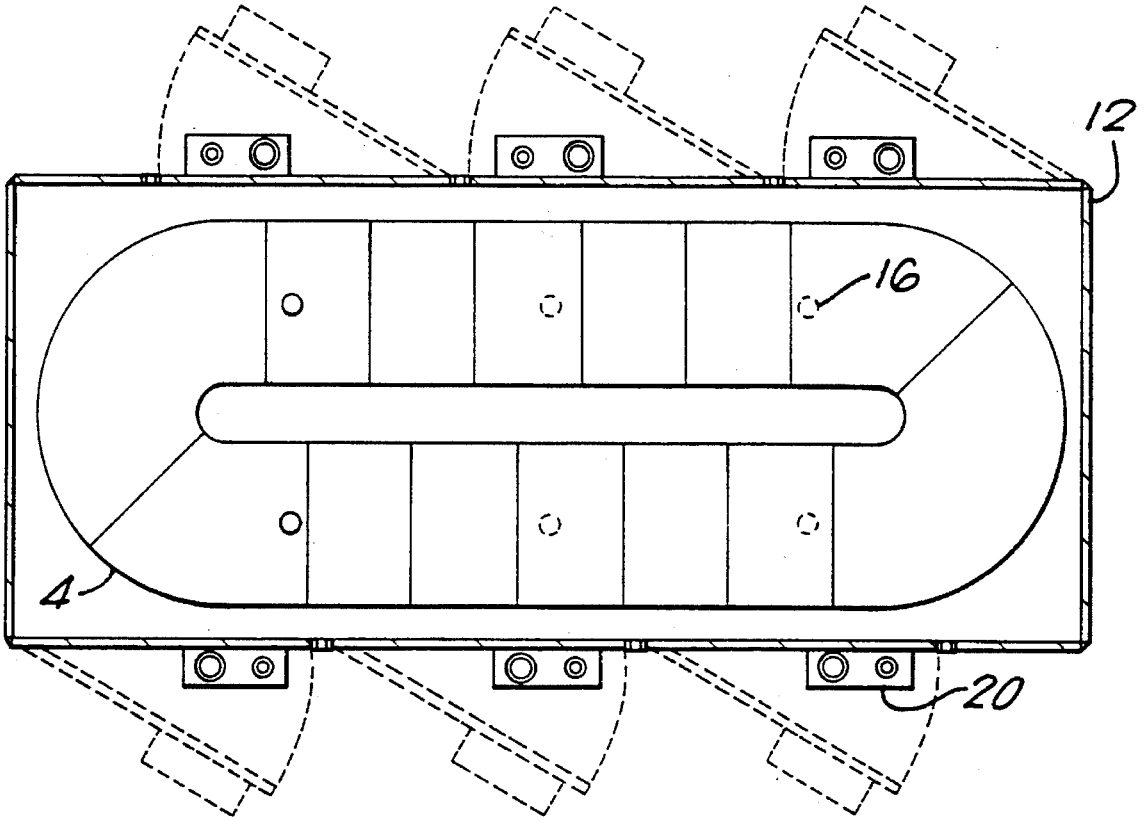
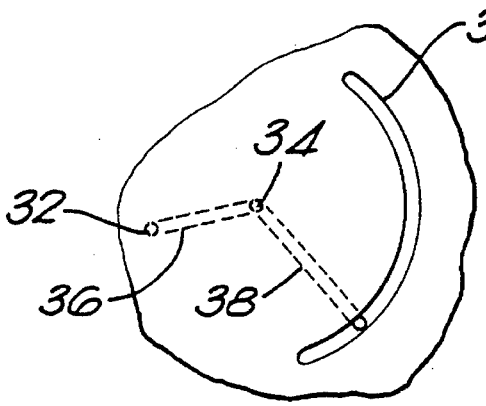
Fig. 3A 54
30
16
47
48
46
42
44
40
36
34
38
54a
50
52
51
42a

AMUSEMENT APPARATUS

The present invention relates to amusement apparatus of the type where a reward, eg a prize, ticket or score point, is given as a consequence of a user hitting a target with some kind of striker.

There are a number of amusement machines currently available based on this principle, and the present invention seeks to improve on existing machines in the sense of enhanced enjoyment value and interest provided by different skill levels.

According to the present invention, there is provided amusement apparatus comprising a number of targets located beneath at least one striker and means for providing relative movement between the two, the or each striker being operatively connected to a user activated mechanism whereby the or each striker may be caused by the user to approach the targets, the targets, being operatively connected to a reward mechanism whereby should a striker hit a particular target the reward mechanism is triggered.

Preferably, the apparatus includes a number of strikers.

Conveniently, the targets are mounted for continuous movement in a circuit located directly beneath the strikers, and the strikers themselves are also mounted for movement independently of the targets, such that the user would move (or stop) the striker until a moving target is about to come directly beneath the striker before activating it.

Preferably, the targets have different "striking areas" those with the largest striking area being the easiest to hit whereas those with the smallest striking area is the most difficult, and by moving or stopping the striker the user can choose which particular target to attempt to hit.

Conveniently, the targets are mounted on a series of substantially horizontal arms, one end of which is rigidly secured to a conveyer mechanism which drives the arms bearing the targets around a race-track shaped circuit. Preferably, each arm has a number of targets mounted thereon, ranging from small to large striking area, with the striker being movable over the entire arm to give the possibility of aiming for any one of the targets along that arm.

In the illustrated embodiment the targets have releasably secured thereto small prizes such as toys, watches etc and the reward mechanism in this embodiment is therefore simply a spring loaded mechanical arrangement for releasably securing the prize to the target such that when the target is depressed by the striker hitting it, the spring is compressed and the prize is released to drop into a dispensing drawer.

Alternative arrangements could incorporate sensors (electronic or opto-electronic) which would sense when a target is hit and send a signal to an appropriate separate reward mechanism, i.e. electronic score board which would cooperate with other elements to give a prize or free game when a particular predetermined score is reached.

Conveniently, the whole apparatus is enclosed within a cabinet having a transparent upper section housing the strikers and targets with most of the mechanical and electronic parts being hidden inside a lower section which also contains the user controls in the form of separate user stations each having a single striker associated with it and comprising controls, a coin or token mechanism for activating the station, and a prize dispensing drawer, In its simplest form each user station would have only a single control to manipulate and fire the particular striker associated with that station, but a variant of the invention has means for moving the striker automatically and in this case the user station includes two controls, one to stop the striker from moving and the other to fire it.

Figure 2:
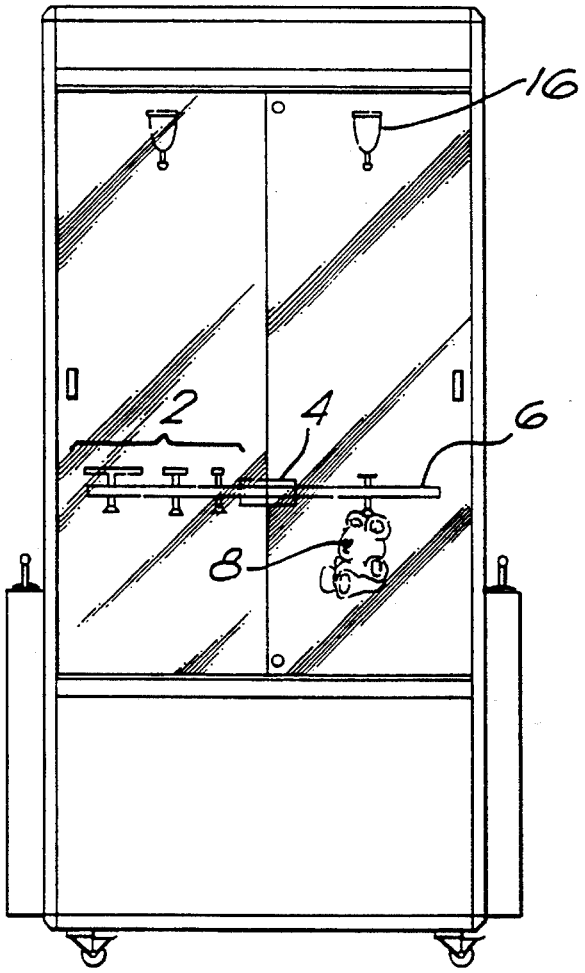
Figure 2A:
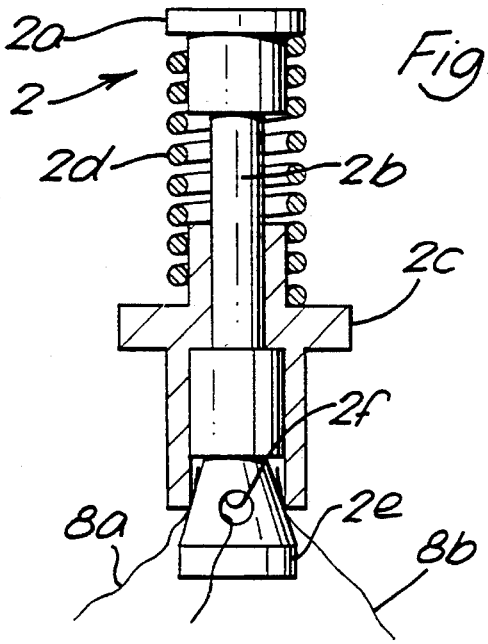
Figure 4:
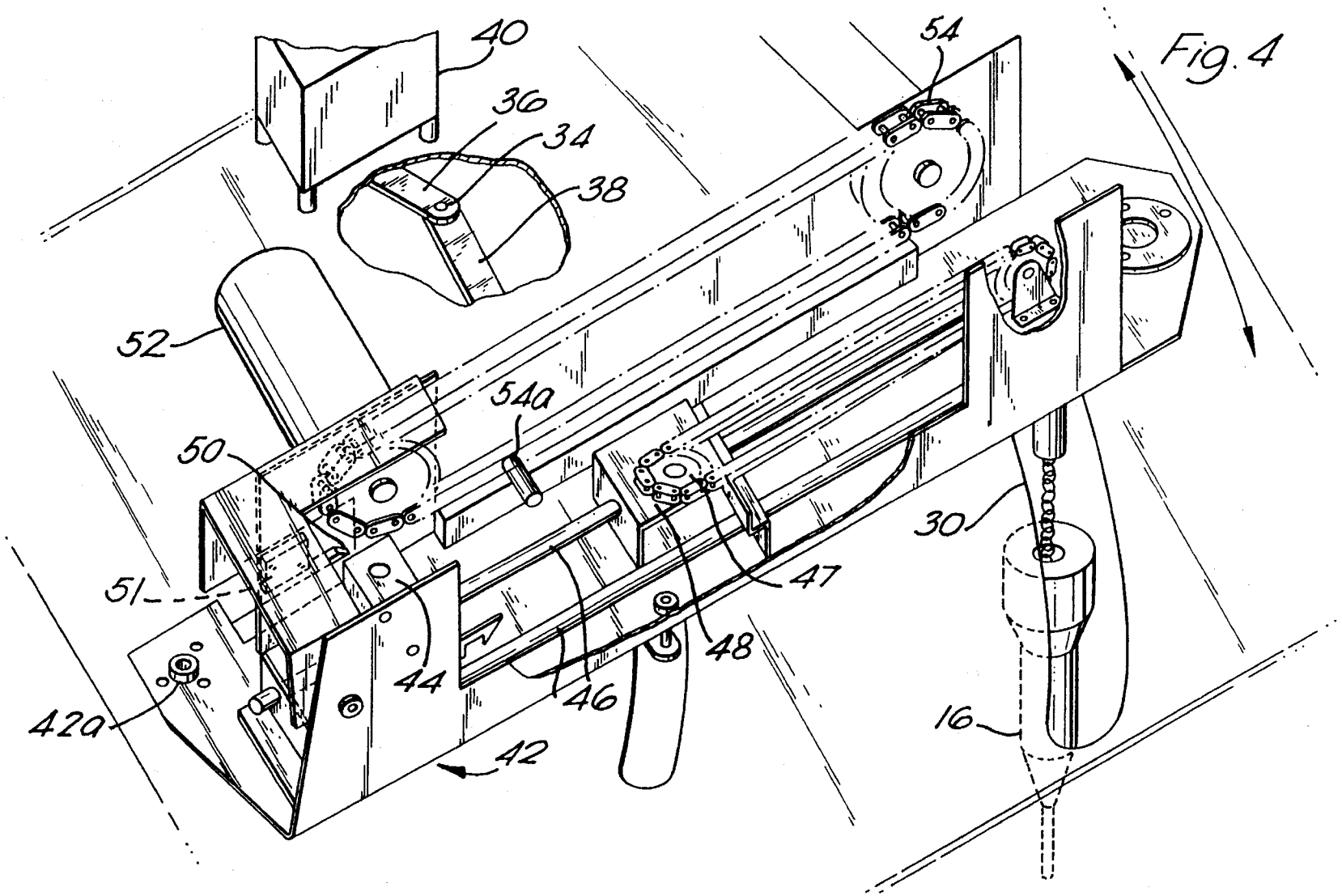

An embodiment of the present invention will now be described, by way of example only, with reference to the accompanying drawings in which:

FIG. 1 is a front elevation of the apparatus in accordance with the present invention, FIG. 2 is a side elevation, FIG. 2A illustrates in detail the prize release mechanism of the target, FIG. 3 is a horizontal sectional view illustrating the target track and the position of the strikers relative thereto, FIG. 3A illustrates in detail the mechanical arrangement for moving the strikers, and FIG. 4 illustrates in detail the arrangement for automatic (motor driven) movement of the strikers.

Referring to the drawings, amusement apparatus in accordance with the present invention comprises a machine 10 comprising a number of targets 2 arranged for continuous movement around an endless conveyer track 4, as well as a number of strikers 16 which take the form of "bombs" attached to a length of chain sufficiently long to allow the bomb, once fired, to reach and strike a target, the chain (not shown) then being reeled in again to ready the bomb for the next firing.

The targets 2 are mounted on a number of arms 6 which are rigidly attached to and extend perpendicularly and horizontally from the conveyor 4, with a number of targets 2 being mounted along the length of each arm as shown in FIG. 2. As can also be seen from FIG. 2, the size of each of the targets 2 along an arm varies, from small through intermediate to large, giving different levels of difficulty according to the target chosen by the user.

The whole machine is mounted within a cabinet 12, the upper part of which is transparent, and may be mounted on castors 13. The machine is intended as a multi-user, coin operated machine, and therefore there are provided a number of user stations 20 comprising coin slot 20*a*, coin refund drawer 20*b*, prize dispenser draw 20*c*, and joystick 20*e* for manually moving the striker to the desired position and then activating the striker, as well as button 20*d* for stopping the movement of the striker. One striker or bomb 16 is associated with each station and is located directly above it.

A prize 8 is releasably attached to each target 2 by means of the arrangement shown in FIG. 2A. Each target comprises a head 2*a* mounted on a shaft 2*b*, the latter being mounted for sliding movement up and down within a hollow body 2*c*. The lowermost end of shaft 2*b* is widened out at 2*e* which end protrudes slightly out of the open base of the hollow body 2*c* when the spring 2*d* is in its uncompressed state. In this state, the prize 8 may be attached by either simply trapping a string attached to the prize between the shaft end 2*e* and the hollow body 2*c* (see string 8*b*) or by additionally threading the string through a hole 2*f* drilled through end 2*e* for the purpose (see string 8*a*). The former arrangement releases the prize immediately the target is hit, whereas the latter arrangement releases the prize gradually during successive "hits" as the string 8*a* gradually drops through hole 2*f*. In either case, hitting the target with the striker compresses the spring 2*d* momentarily and forces shaft 2*b* downwards through hollow body 2*c*.

Referring to FIGS. 3 and 3A, the strikers or bombs 16 may themselves be made to move during the game, either by the user manipulating the joystick 20*e*, or automatically being stopped at will by the user pressing button 20*d*. For this purpose an arcuate slot 30 is utilised, along which the upper end of the striker travels, driven (in the case of automatic movement) by a motor acting through arms 36 and 38 which are pivoted at points 32 and 34. As can be seen in FIG. 4, the bomb 16 scans over the moving targets, travelling along slot 30, driven by a motor which, acting through crank arm 36,38, causes the whole of the slide mechanism 42 to pivot around pivot bush 42*a*. When the bomb 16 is activated via processor control, the release solenoid 44 is activated, releasing the slide mechanism comprising slide rods 46, slide 48, chain and pulley 47 such that the slide 48 is pulled by the weight of the bomb 16 along the slide rods 46. Upon commencing its outward journey, the slide 48 releases the limit switch 51, which in turn starts the motor 52 via processor control. The bomb reset peg 54A catches the slide 48, thus drawing the bomb upwards ready to be activated again.

In use, the conveyer 4 could be in continuous motion regardless of the use of the machine, and upon inserting a coin at a particular user station that station would be activated and the user can move or stop the striker associated with that station before releasing it at will using the appropriate controls. Thus, by moving the striker 16 or by stopping it at the appropriate point along the arcuate slot 30, the user can choose which of the targets 2 (small, intermediate or large) he will attempt to hit.

One of the advantages of the machine is than because there are a number of targets mounted on each arm, the machine has the capacity to reduce the number of times it has to be refilled with prizes, thus significantly reducing "down time".

We claim:

1. Amusement apparatus comprising a number of targets located beneath at least one striker and means for providing relative movement between the two, the or each striker being operatively connected to a user activated mechanism whereby the or each striker may be caused by the user to approach the targets, the targets being operatively connected to a reward mechanism whereby should a striker hit a particular target the reward mechanism is triggered, wherein said at least one striker is automatically retrieved after each activation from a "fired" position close to or adjacent the targets, to a stowed position some distance away from the targets, so as to be ready for the next activation.

2. Apparatus according to claim 1 wherein the apparatus includes a number of strikers.

3. Apparatus according to claim 1 wherein the targets are mounted for continuous movement in a circuit located directly beneath the strikers, and the strikers themselves are also mounted for movement independently of the targets, such that the user would move (or stop) the striker until a moving target is about to come directly beneath the striker before activating it.

4. Apparatus according to claim 1 wherein the targets have different "striking areas" being of either small, intermediate or large area.

5. Apparatus according to claim 1 wherein the targets are mounted on a series of substantially horizontal arms, one end of the arms being rigidly secured to a conveyer mechanism which drives the arms bearing the targets around a race-track shaped circuit.

6. Apparatus according to claim 5 wherein each arm has a number of targets mounted thereon, ranging from small through intermediate to large striking area, with the striker being movable over the entire arm to allow aiming for any one of the targets along the arm.

7. Apparatus according to claim 1 wherein the targets have releasably secured thereto small prizes such as toys, watches etc by means of a spring loaded mechanical arrangement such that when the target is depressed by the striker hitting it, the spring is compressed and the prize is released to drop into a dispensing drawer.

8. Apparatus according to claim 1 wherein there is incorporated sensors (electronic or opto-electronic) which would sense when a target is hit and send a signal to an appropriate separate reward mechanism.

9. Apparatus according to claim 1 wherein the apparatus includes at least one user station, each user station being associated with a striker and having a single control to manipulate and fire said striker.

10. Apparatus according to claim 1 wherein the apparatus includes at least one user station and includes means for moving the striker automatically, each user station being associated with a striker and having two controls, the two controls including one control to stop the striker from moving and the other control to fire the striker.

11. Apparatus according to claim 1 wherein said at least one striker is mounted on a length of chain, said chain being connected to a slide mechanism slidable between extended and stowed positions, the slide being pulled into said extended position by the weight of said at least one striker, and being driven by a motor back into the stowed position, the extended position of the slide corresponding to the "fired" position of the striker, and the stowed position of the slide corresponding to the stowed position of the striker.

* * * * *